US007806992B2

(12) United States Patent
Hase et al.

(10) Patent No.: US 7,806,992 B2
(45) Date of Patent: Oct. 5, 2010

(54) HOT FORGED PRODUCT WITH EXCELLENT FATIGUE STRENGTH, METHOD FOR MAKING THE SAME, AND MACHINE STRUCTURAL PART MADE FROM THE SAME

(75) Inventors: Kazukuni Hase, Tokyo (JP); Hideto Kimura, Tokyo (JP); Takaaki Toyooka, Tokyo (JP)

(73) Assignee: JFE Steel Corporation (JP)

( * ) Notice: Subject to any disclaimer, the term of this patent is extended or adjusted under 35 U.S.C. 154(b) by 440 days.

(21) Appl. No.: 11/885,213

(22) PCT Filed: Jun. 5, 2006

(86) PCT No.: PCT/JP2006/311675

§ 371 (c)(1),
(2), (4) Date: Aug. 28, 2007

(87) PCT Pub. No.: WO2007/000888

PCT Pub. Date: Jan. 4, 2007

(65) Prior Publication Data

US 2008/0264530 A1 Oct. 30, 2008

(30) Foreign Application Priority Data

Jun. 29, 2005 (JP) ..... 2005-190220
Jul. 14, 2005 (JP) ..... 2005-205170

(51) Int. Cl.

| | |
|---|---|
| ***C21D 1/18*** | (2006.01) |
| ***C21D 8/00*** | (2006.01) |
| ***C21D 9/00*** | (2006.01) |
| ***C22C 38/02*** | (2006.01) |
| ***C22C 38/04*** | (2006.01) |

(52) U.S. Cl. ..... 148/320; 148/639; 148/643; 148/644; 148/649; 148/902

(58) Field of Classification Search ..... 148/639, 148/644, 649, 902, 320, 330–336, 643
See application file for complete search history.

(56) References Cited

U.S. PATENT DOCUMENTS 5,759,309 A * 6/1998 Watts et al. ..... 148/637

FOREIGN PATENT DOCUMENTS

| | | | |
|---|---|---|---|
| JP | 3100492 | B2 | 8/2000 |
| JP | 2002-226938 | A | 8/2002 |
| JP | 2003-193139 | A | 7/2003 |
| JP | 2004-060003 | A | 2/2004 |
| JP | 2004-60003 | A | 2/2004 |
| KR | 2003-76396 | A | 9/2003 |

OTHER PUBLICATIONS

Machine- English translation of Japanese patent 2002-226938, Kitano Shuhei, Aug. 14, 2002.*

(Continued)

*Primary Examiner*—Deborah Yee
(74) *Attorney, Agent, or Firm*—DLA Piper LLP (US)

(57) ABSTRACT

A hot forged product including hardened areas introduced by partial cooling after hot forging, and unhardened areas, wherein Vickers hardness $V_1$ of the hardened areas on the surface and Vickers hardness $V_2$ of the unhardened areas satisfy the following formula (1): $(V_1-V_2)/V_2$: 0.1 to 0.8.

6 Claims, 4 Drawing Sheets

OTHER PUBLICATIONS

Machine-English translation of Japanese patent 2004-060003, Morishima Takeshi, Feb. 26, 2004.*
"Martensite Transfomation in iron-carbon alloys", pp. 141-142, Structure and Properties of Engineering Materials, Brick et al. 1977.*
English abstract of Japanese patent 408176733, Koji Izumi et al., Jul. 9, 1996.*
"Denko Giho," Denki Kogyo Co., Ltd., vol. 37, 2003, pp. 52-56 w/English translation and Verification of Translation.

* cited by examiner

HOT FORGED PRODUCT WITH EXCELLENT FATIGUE STRENGTH, METHOD FOR MAKING THE SAME, AND MACHINE STRUCTURAL PART MADE FROM THE SAME

RELATED APPLICATION

This is a §371 of International Application No. PCT/JP2006/311675, with an international filing date of Jun. 5, 2006 (WO 2007/000888 A1, published Jan. 4, 2007), which is based on Japanese Patent Application Nos. 2005-190220, filed Jun. 29, 2005, and 2005-205170, filed Jul. 14, 2005.

TECHNICAL FIELD

This disclosure relates to hot forged products, specifically to a hot forged product with excellent fatigue strength which is provided as a half-finished product before finishing for automobile steel parts, for example, axle units such as a constant-velocity universal joint and a hub, and machine structural parts typified by engine parts such as a crankshaft.

BACKGROUND

Steel products used as automatic axle units or engine parts are commonly manufactured by hot forging followed by machine finishing. In recent years, products for such purposes have been required to have a higher fatigue strength to achieve a reduction in size and wall thickness with the intention of reducing the weight of automobiles.

For example, as a technique for improving the fatigue strength of a hot forged product, Japanese Patent No. 3,100,492 discloses a method for making a hot forged product with high fatigue strength, wherein a forged product after hot forging is totally quenched, and then tempered to strengthen the product by precipitation hardening.

However, according to the method described in Japanese Patent No. 3,100,492, a hot forged product is totally subjected to direct cooling, which increases the hardness of the entire product thus decreasing the machinability of areas which are not to required to have high fatigue strength. A machine structural part for the above-described purposes is manufactured by roughly forming a product shape by hot forging, and then finishing the surface layer of the hot forged product usually by machining the entire surface layer. Accordingly, machining and surface grinding are indispensable in the manufacture of a machine structural part of this type, so that the increase in the hardness of the entire part inevitably decreases the tool life, which presents a serious problem.

In addition, precipitation hardening treatment requires additional tempering treatment, which is not preferable from the viewpoint of energy saving.

It could therefore be advantageous to provide a hot forged product and a method for advantageously making the same.

SUMMARY

We conducted investigations regarding partial cooling specifically after hot forging, and discovered the following (I) to (III):

(I) When a hot forged product is partially quenched by cooling specifically the areas required to have high fatigue strength, if the hardness of the areas is increased by 10% or more, the fatigue strength of the part can be increased by 20% or more.

(II) The quenched areas by partial cooling are self-tempered by heat remaining in the uncooled areas, which is as effective as existing tempering treatment which has been conducted as an additional process. The self-tempering treatment must satisfy a specific parameter to achieve the effect.

(III) Accordingly, there is no need to temper the forged product after cooling to room temperature, which enables the manufacture of a hot forged product with high fatigue strength at a markedly low cost.

Thus, we provide:

1. A hot forged product having hardened areas introduced by partial cooling after hot forging, and unhardened areas, wherein Vickers hardness $V_1$ of the hardened areas on the surface and Vickers hardness $V_2$ of the unhardened areas satisfy the following formula (1):

$$(V_{1-V2})/V_2: 0.1 \text{ to } 0.8 \quad (1).$$

2. The hot forged product according to 1, wherein the hardened areas are composed of martensite and/or bainite.
3. A machine structural part made by cold finishing the hot forged product according to 1 or 2.
4. A method for making a hot forged product containing steps of partially cooling a hot forged product from $A_{C3}$+100° C. or higher to $A_{C1}$−150° C. or lower at a cooling rate of 20° C./s or more, and subsequently tempering the areas by recuperation within the temperature range not exceeding the $A_{C1}$ point.
5. The method for making a hot forged product according to 4, wherein the parameter H defined by the following formula (2) from the average temperature $T_n$ (K) measured over a period of $\Delta t_n$ seconds satisfies $65 \leqq H \leqq 85$ during the period after stopping the cooling to the point where the temperature reaches 300° C. in the temperature reduction process after recuperation:

$$H=\log_{10}\Sigma 10^{f_n} \quad (2)$$

wherein $f_n=\log \Delta T_n-1.597\times10^4/T_n+100$.

We thereby provide a hot forged product having fatigue strength 20% higher than that of existing hot forged products together with a good tool life.

Figure 1:
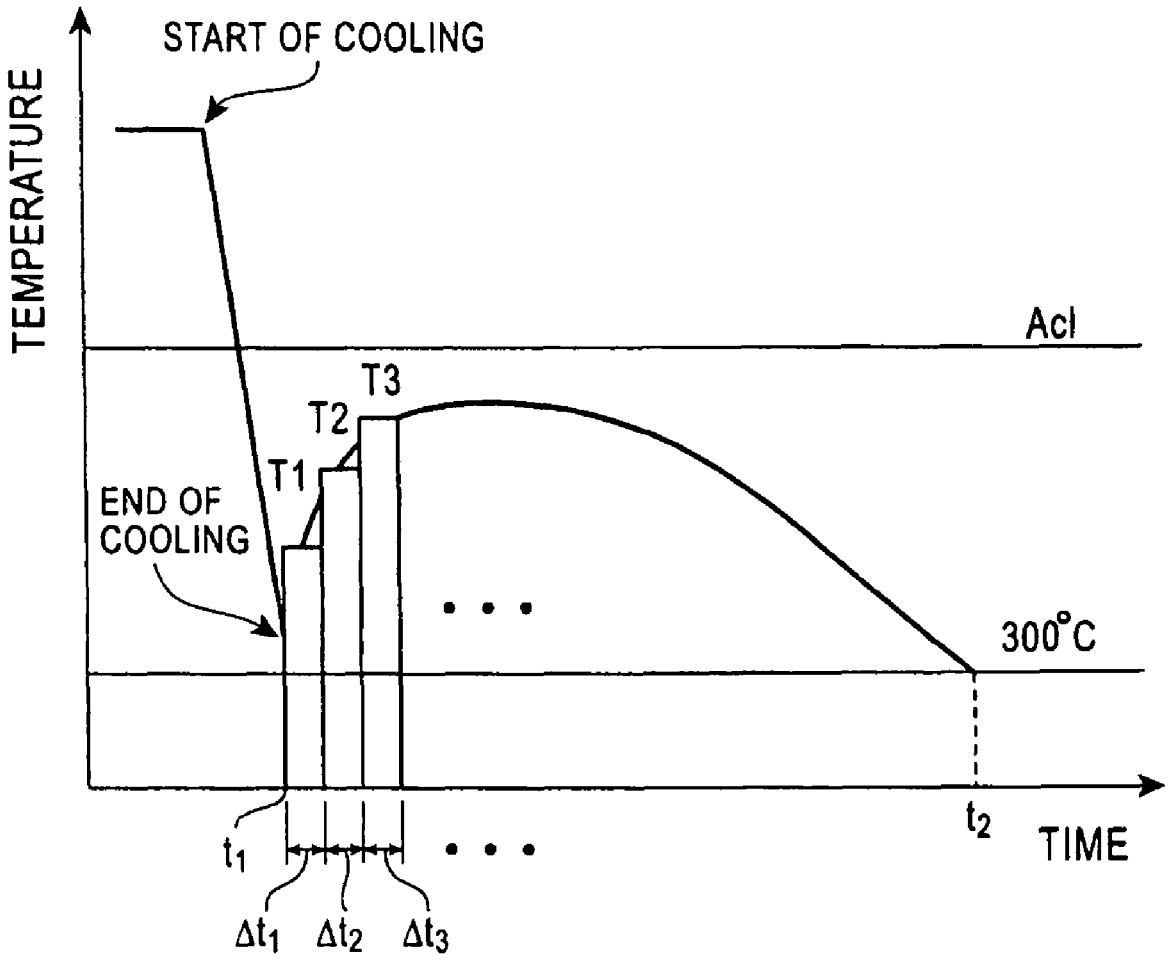
FIG. 1 is a schematic diagram of a temperature history in recuperation.

1 hot forged product 1,

1*a* flange base,

1*b* axis end.

DETAILED DESCRIPTION

Our hot forged products have hardened areas introduced by partial cooling just after hot forging and unhardened areas other than the hardened areas, wherein Vickers hardness $V_1$ of the hardened areas on the surface and Vickers hardness $V_2$ of the unhardened areas satisfies the following formula:

$$(V_{1-V2})/V_2: 0.1 \text{ to } 0.8.$$

More specifically, if the ratio $(V_1-V_2)/V_2$ is less than 0.1, the strength of the hardened areas is less increased, so that the fatigue strength is not sufficiently improved. On the other hand, if the ratio $(V_1-V_2)/V_2$ is more than 0.8, the hardness is too high, which results in significant deterioration in cold processability such as machinability. Particularly, hot forging is followed by direct partial quenching so that subsequent machining is indispensable. Accordingly, the ratio $(V_1-V_2)/V_2$ must be 0.8 or less, and is most preferably in the range of 0.2 to 0.6.

The hardened areas having such a hardness difference are composed of martensite and/or bainite, and the unhardened areas are composed mainly of ferrite and/or perlite, and may partially contain bainite.

The hot forged product described above is obtained by hot forging followed by direct partial quenching, and then self-tempering. The hot forged product is subsequently subjected to machine finishing to make a machine structural part.

The next section describes the conditions for manufacturing a hot forged product which satisfies $(V_1-V_2)/V_2$: 0.1 to 0.8.

More specifically, a steel material is heated and then subjected to hot forging in a hot forging machine in accordance with a common method for manufacturing a product of this type. The forged product thus obtained is partially cooled from $A_{C3}$+100° C. or higher to $A_{C1}$−150° C. or lower at a cooling rate of 20° C./s or more. More specifically, the areas which are required to have high fatigue strength after hot forging are cooled from $A_{C3}$+100° C. or higher to $A_{C1}$−150° C. or lower at a cooling rate of 20° C./s or more, which produces a structure composed of martensite and/or bainite with the generation of ferrite suppressed during cooling.

The reason that the partial cooling after hot forging is conducted in the temperature range from $A_{C3}$+100° C. or higher to $A_{C1}$−150° C. or lower is that cooling from $A_{C3}$+100° C. or higher is indispensable for achieving a sufficient recuperation effect after cooling, and the purpose of cooling at $A_{C1}$−150° C. or lower is to suppress the generation of ferrite.

In addition, the purpose of cooling at a rate of 20° C./s or more within the temperature range is to suppress transformation into ferrite during cooling thereby producing a structure composed of martensite and/or bainite.

Subsequently, the forged product is continuously tempered in a temperature range which does not exceed the $A_{c1}$ point by recuperation based on heat remaining in the part. More specifically, if the temperature of tempering by recuperation is higher than the $A_{c1}$ point, the structure formed by partial quenching transforms to austenite, and then transforms to a ferrite/perlite structure during the subsequent cooling process. To prevent this, the forged product is tempered within a temperature range not exceeding the $A_{c1}$ point.

In addition, regarding the tempering by recuperation, the parameter H, which is defined by the following formula (2) from the average temperature $T_n$ (K) measured over a period of $\Delta t_n$ seconds, satisfies $65 \leqq H \leqq 85$ during the period after stopping the cooling to the point where the temperature reaches 300° C. in the temperature reduction process after recuperation:

$$H=\log_{10}\Sigma 10^{f_n} \quad (2)$$

wherein $f_n=\log \Delta t_n-1.597\times10^4/T_n+100$.

FIG. 1 shows the temperature history during recuperation of the partially cooled areas. From the cooling curve shown in FIG. 1, the average temperature $T_n$(K) is measured over a period of $\Delta t_n$ from the point $t_1$ where the cooling is stopped to the point $t_2$ where the temperature reached 300° C. in the temperature reduction process after recuperation, and the average temperature is assigned to the formula (2) to determine the parameter H. The temperature $T_n$ continuously changes during the self-tempering process, so that $\Delta t_n$ is assumed to be 0.5 second or less.

Figure 2:
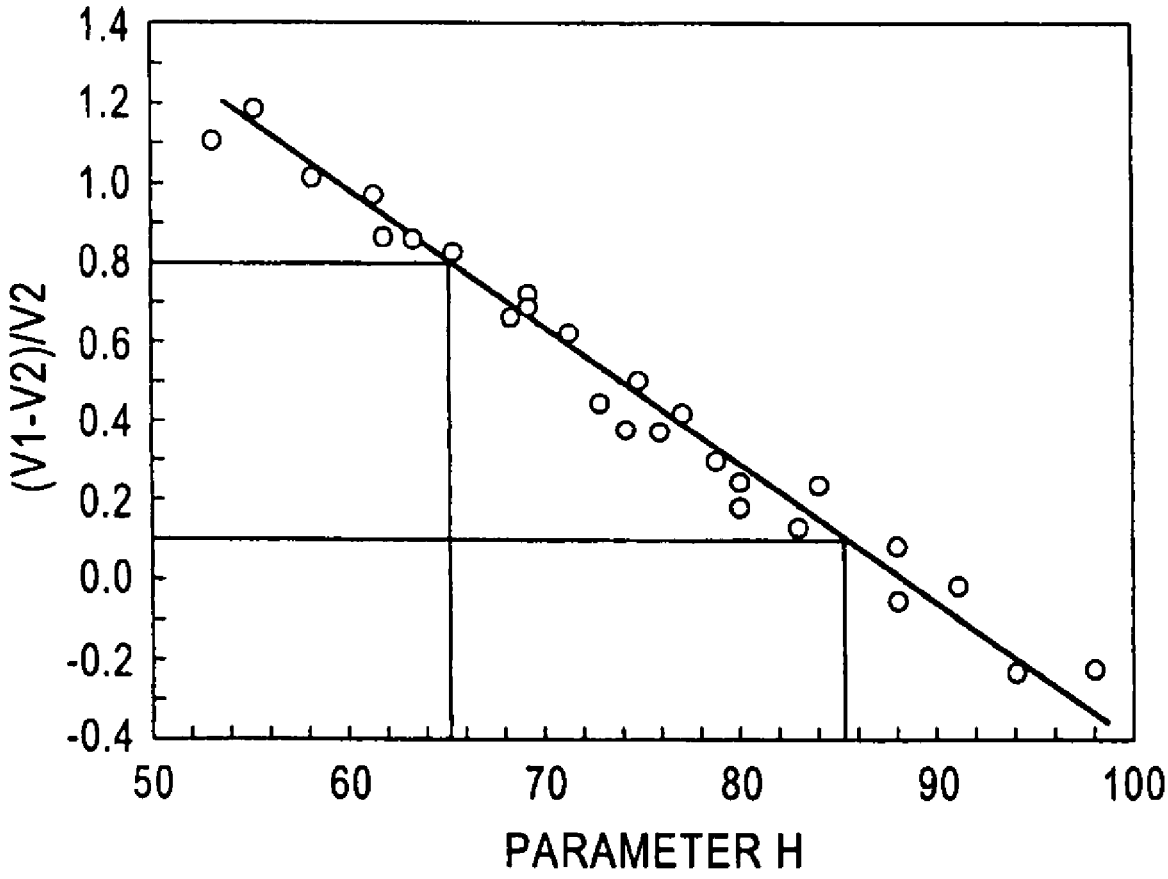
FIG. 2 is a drawing showing a relationship between the parameter H and $(V_1-V_2)/V_2$.

FIG. 2 shows the relationship between the above-described ratio $(V_1-V_2)/V_2$ and the parameter H. As shown in FIG. 2, the parameter H is in good correlation with the hardness ratio. If the parameter H is less than 65, the tempering effect is insufficient so that the hardness ratio $(V_1-V_2)/V_2$ exceeds 0.8, which presents a problem with tool life. On the other hand, if the parameter H is more than 85, the hardness ratio $(V_1-V_2)N_2$ becomes less than 0.1 because of excessive softening, which results in a failure to improve the fatigue strength.

As described above, our hot forged products are obtained by conducting partial cooling treatment under specified conditions. The hot forged product does not depend on its elemental composition, but preferably has the following elemental composition.

C: about 0.3 to about 0.9 mass %

C is a necessary element to improve the strength of steel. If the content of C is less than 0.3 mass %, necessary strength is not achieved, on the other hand, if more than 0.9 mass %, the tool life, fatigue strength, and forging properties deteriorate. Therefore, 0.3 to 0.9 mass % is defined as a preferable range.

Si: about 0.01 to about 1.2 mass %

Si serves as a deoxidizer, and effectively contributes to the improvement in the strength. If the content of Si is less than about 0.01 mass %, the effect is insufficient, and if more than about 1.2 mass %, the forging properties and cold processability deteriorate. Therefore, about 0.01 to about 1.2 mass % is defined as a preferable range.

Mn: about 0.01 to about 2.0 mass %

Mn effectively improves the fatigue strength as well as strength. If the content of Mn is less about 0.01 mass %, the effect is insufficient, and if more than about 2.0 mass %, the forging properties and tool life deteriorate. Therefore, about 0.01 to bout 2.0 mass % is defined as a preferable range.

In addition to the above-described preferable main elements, the following elements may be added as appropriate to further improve the fatigue strength.

Mo: about 0.05 to about 0.60 mass %

Mo is a useful element for suppressing the growth of ferrite grains. For the purpose, the content of Mo at least about 0.05 mass % or more, but if the content is more than about 0.60 mass %, tool life deteriorates. Therefore, the content is preferably from about 0.05 to about 0.60 mass %.

Al: about 0.01 to about 0.06 mass %

Al serves as a deoxidizer for the steel. However, if the content of Al is less than about 0.01 mass %, the effect is poor, and if more than about 0.06 mass %, tool life and fatigue strength deteriorates. Therefore, the content is preferably from about 0.01 to about 0.06 mass %.

Ti: about 0.005 to about 0.050 mass %

Ti is a useful element for refining crystal grains through the pinning effect of TiN. The content of Ti is at least about 0.005 mass % or more to achieve the effect, but if the content is more than about 0.050 mass %, the fatigue strength deteriorates. Therefore, the content is preferably in the range of about 0.005 to about 0.050 mass %.

Ni: about 1.0 mass % or less

Ni is an effective element for increasing strength and preventing hot shortness caused by Cu addition, and the content of Ni is preferably about 0.05 mass %. If the content is more than about 1.0 mass %, quenching cracks tend to occur. Therefore, the content is preferably limited to about 1.0 mass % or lower.

Cr: about 1.0 mass % or less

Cr is effective for increasing strength and the content of Cr is preferably about 0.05 mass % or more. If the content is more than about 1.0 mass %, carbide is stabilized to promote the generation of residual carbide, which results in the deterioration of the grain boundary strength and the fatigue strength. Therefore, the content is preferably limited to about 1.0 mass % or lower.

V: about 0.1 mass % or less

V is a carbide-forming element and refines the structure through pinning. The content of V is preferably about 0.005 mass % or more, and the effect is saturated when the content exceeds about 0.1 mass %. Therefore, the content is preferably limited to about 0.1 mass %.

Cu: about 1.0 mass % or less

Cu is an element which improves the strength through solute strengthening and precipitation hardening, and is effective for improving hardenability by quenching. The content of Cu is preferably about 0.1 mass % or more, but if the content is more than about 1.0 mass %, cracks occur during hot processing. Therefore, the content is preferably limited to about 1.0 mass % or less.

Nb: about 0.05 mass % or less

Nb precipitates in the form of a carbide or carbonitride, and suppresses the grain growth through pinning. The content of Nb is preferably about 0.005 mass % or more, and the effect is saturated when the content exceeds about 0.05 mass %. Therefore, the content is preferably limited to about 0.05 mass % or less.

Ca: about 0.008 mass % or less

Ca spheroidizes nonmetallic inclusions, and improves the fatigue properties. The content of Ca is preferably about 0.001 mass % or more. If the content is more than about 0.008 mass %, the nonmetallic inclusions is coarsened to deteriorate the fatigue properties. Therefore, the content is preferably limited to about 0.008 mass % or less.

B: about 0.004 mass % or less

B locally deposits at the grain boundary to enhance the grain boundary thereby improving the fatigue strength, and is also a useful element for improving the strength. The content of B is preferably about 0.003 mass % or more, and the effect is saturated when the content exceeds about 0.004 mass %. Therefore, the content is preferably limited to about 0.008 mass % or less.

The remainder is Fe and unavoidable impurities. Examples of the unavoidable impurities include P, S, O, and N.

EXAMPLE

Figure 3:
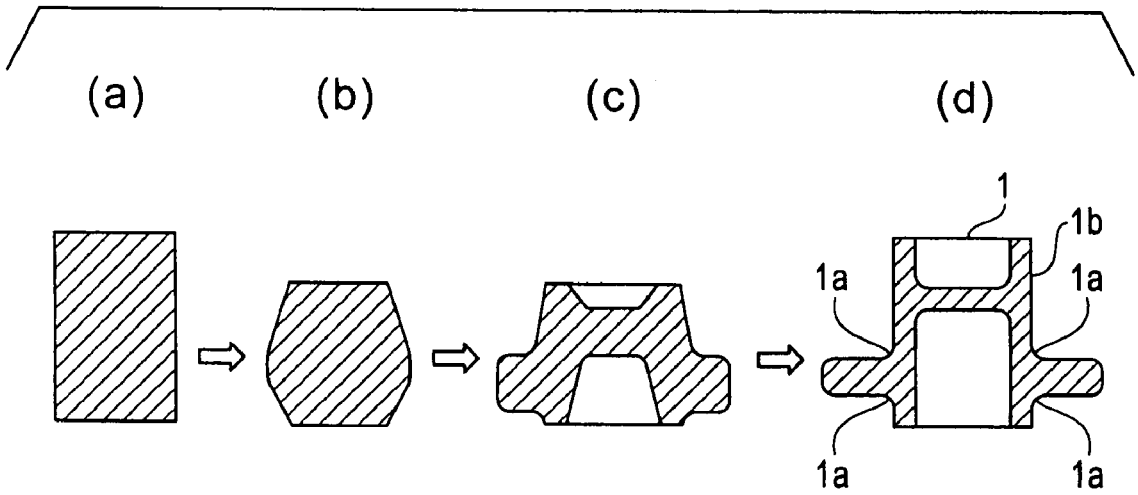
FIG. 3 is a process chart showing the procedure of hot forging.

The steel having elemental compositions listed in Table 1 was melted in a vacuum melting furnace, and cast into an ingot of 100 kg. Subsequently, the ingot was subjected to hot forging to make a rolled round steel bar having a diameter of 65 mm. The rolled round steel bar was heated to 1,000 to 1,200° C., and then subjected to three-step hot forging as shown in FIG. 3 to form a hot forged product 1 having a flange indicated with (d) in FIG. 3. After the hot forging, partial cooling was conducted exclusively on the flange base 1*a*, and then the product was allowed to cool.

The temperature of hot forging was measured with a radiation thermometer. After the hot forging, the temperature history was measured with a thermocouple attached to the flange base 1*a*, from which the self-tempering parameter H was calculated. In the calculation, Δt was 0.5 seconds, and the temperature T was the average temperature (K) measure over a period of Δt.

The hot forged products thus obtained were subjected to the structure observation, hardness measurement, bending fatigue test, and machining test by the following procedures. For comparison, forged products were prepared by a conventionally used hot forging-air cooling process, and a hot forging-total quenching-tempering process. After the total quenching, tempering treatment was conducted at a tempering temperature of 600° C. for 1 hour. Some hot forged-air cooled products were further subjected to high frequency quenching treatment.

The structure observation was conducted as follows: samples for structure observation were cut out from the flange base 1*a* and the axis end 1*b* of the hot forged products, etched with nital, and the etched structures were observed with an optical microscope and an electron microscope.

The Vickers hardness was measured as follows: the Vickers hardness of the flange base 1*a* and the axis end 1*b* was measured at a depth of 1 mm from the surface layer under a load of 300 g.

Figure 4:
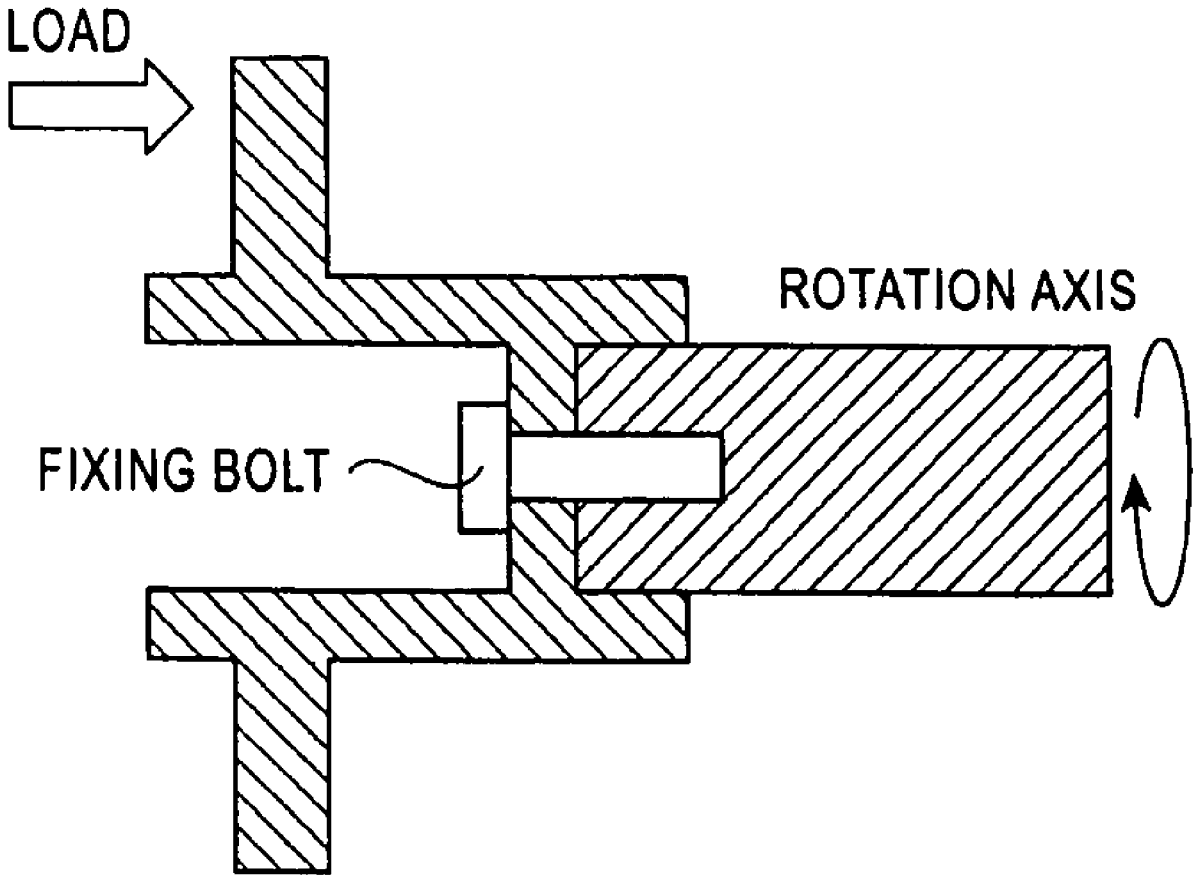
FIG. 4 is a drawing showing the outline of the bending fatigue test. Reference numerals in FIG. 3 denote the followings.

The bending fatigue test was conducted as follows: as shown in FIG. 4, a hot forged product was attached to a rotation axis with a fixing bolt, and subjected to endurance test in which a load was applied to the flange portion with the product being rotated at a rotation speed of 800 rpm, and the fatigue strength to provide an endurance time of 120 hours was determined.

The machinability on the basis of machining test were evaluated by periphery machining. More specifically, the entire product was machined using a carbide tool P10 while sprayed with a lubricant, at a machining speed of 200 m/min, a cutting depth of 0.25 mm, and a feed speed of 0.5 mm/rev, and the time required to machine the entire product was defined as t2 with reference to the time t1 required to machine the product prepared by the conventional hot forging-air cooling process, and evaluation was conducted in terms of (t2−t1)/t1.

TABLE 1

| Steel | Chemical composition (mass %) | | | | | | | | | | | | | | | Transformation point (° C.) | |
|---|---|---|---|---|---|---|---|---|---|---|---|---|---|---|---|---|---|
| No. | C | Si | Mn | Mo | P | S | Al | Cu | Ni | Nb | Cr | Ti | V | B | Ca | $A_{c3}$ | $A_{c1}$ |
| 1 | 0.54 | 0.23 | 0.83 | — | 0.014 | 0.015 | 0.026 | — | — | — | 0.20 | — | — | — | — | 771 | 724 |
| 2 | 0.31 | 0.22 | 0.64 | — | 0.014 | 0.008 | 0.021 | — | — | — | — | — | — | — | — | 807 | 723 |

TABLE 1-continued

| Steel | Chemical composition (mass %) | | | | | | | | | | | | | | | Transformation point (° C.) | |
|---|---|---|---|---|---|---|---|---|---|---|---|---|---|---|---|---|---|
| No. | C | Si | Mn | Mo | P | S | Al | Cu | Ni | Nb | Cr | Ti | V | B | Ca | $A_{c3}$ | $A_{c1}$ |
| 3 | 0.53 | 0.69 | 0.8 | — | 0.015 | 0.015 | 0.019 | — | 0.05 | — | 0.16 | — | 0.03 | — | — | 795 | 736 |
| 4 | 0.45 | 0.66 | 0.55 | 0.36 | 0.010 | 0.010 | 0.030 | 0.16 | 0.21 | 0.021 | — | 0.015 | 0.02 | 0.002 | 0.004 | 817 | 733 |
| 5 | 0.51 | 0.76 | 0.62 | 0.54 | 0.021 | 0.009 | 0.025 | 0.31 | — | — | — | — | — | — | — | 816 | 738 |

$A_{c3} = 910 - 203\sqrt{C} - 15.2Ni + 44.7Si + 104V + 31.5Mo$ $A_{c1} = 723 - 10.7Mn - 16.9Ni + 29.1Si + 16.9Cr$

TABLE 2

| No. | Steel type | Temperature of hot forging | Temperature at start of cooling | Cooling rate (° C.) | Temperature at end of cooling | Recuperation maximum temperature (° C.) | Parameter H | Hardened area Structure | Hardened area $V_1$ (Hv) | Unhardened Area Structure | Unhardened Area $V_2$ (Hv) | $(V_1 - V_2)/V_2$ | Fatigue strength (MPa) | Machining time ratio | Remark |
|---|---|---|---|---|---|---|---|---|---|---|---|---|---|---|---|
| 1 | 1 | 1200 | 1100 | 35 | 203 | 560 | 60 | M | 332 | F + P | 234 | 0.42 | 440 | 1.1 | Example of Invention |
| 2 | | 1200 | 1150 | 22 | 214 | 620 | 84 | M | 269 | F + P | 236 | 0.14 | 360 | 1.0 | Example of Invention |
| 3 | | 1050 | 980 | 34 | 229 | 370 | 67 | M | 427 | F + P | 241 | 0.77 | 480 | 1.2 | Example of Invention |
| 4 | | 1150 | 1100 | 38 | 340 | 550 | 81 | B | 301 | F + P | 243 | 0.24 | 380 | 1.0 | Example of Invention |
| 5 | | 1150 | 1100 | 51 | 270 | 540 | 79 | M + B | 354 | F + P | 239 | 0.48 | 470 | 1.1 | Example of Invention |
| 6 | | 1150 | 850 | 29 | 204 | 290 | 61 | M | 512 | F + P | 237 | 1.18 | 290 | 2.1 | Comparative Example |
| 7 | | 1150 | 850 | 32 | 210 | 340 | 62 | M | 519 | F + P | 235 | 1.21 | 310 | 2.0 | Comparative Example |
| 8 | | 1150 | 1100 | 31 | 590 | 740 | 84 | F + P + B | 239 | F + P | 234 | 0.02 | 290 | 1.0 | Comparative Example |
| 9 | | 1250 | 1200 | 30 | 230 | 700 | 87 | M | 255 | F + P | 236 | 0.08 | 310 | 1.1 | Comparative Example |
| 10 | | 1150 | 1100 | 16 | 370 | 540 | 81 | P | 253 | F + P | 234 | 0.08 | 300 | 1.0 | Comparative Example |
| 11 | | 1150 | 1100 | 0.5 | — | — | — | — | — | F + P | 231 | — | 280 | 1.0 | Comparative Example: existing process |
| 12 | | 1150 | 1100 | 36 | Room temperature | — | — | M | 360 | — | — | — | 420 | 4.2 | Comparative Example: existing process, total quenching-tempering |
| 13 | 1 | 1150 | 1100 | 0.5 | — | — | — | M | 700 | F + P | 231 | — | 430 | 2.4 | Comparative Example: high frequency quenching |
| 14 | 2 | 1100 | 1030 | 26 | 367 | 560 | 83 | M | 296 | F + P | 224 | 0.32 | 380 | 1.1 | Example of Invention |
| 15 | | 1100 | 4030 | 0.7 | — | — | — | — | — | F + P | 226 | — | 272 | 1.0 | Comparative Example: existing process |
| 16 | 3 | 1140 | 1050 | 27 | 260 | 530 | 81 | M | 342 | F + P | 267 | 0.28 | 450 | 1.2 | Example of Invention |
| 17 | | 1140 | 1050 | 0.7 | — | — | — | — | — | | 267 | — | 360 | 1.0 | Comparative Example: existing process |

TABLE 2-continued

| No. | Steel type | Temperature of hot forging | Temperature at start of cooling | Cooling rate (° C.) | Temperature at end of cooling | Recuperation maximum temperature (° C.) | Parameter H | Hardened area Structure | Hardened area $V_1$ (Hv) | Unhardened Area Structure | Unhardened Area $V_2$ (Hv) | $(V_1 - V_2)/V_2$ | Fatigue strength (MPa) | Machining time ratio | Remark |
|---|---|---|---|---|---|---|---|---|---|---|---|---|---|---|---|
| 18 | 4 | 1080 | 1020 | 23 | 305 | 520 | 79 | M | 339 | B | 285 | 0.19 | 450 | 1.1 | Example of Invention |
| 19 | | 1080 | 1020 | 0.6 | — | — | — | — | — | | 279 | — | 356 | 1.0 | Comparative Example: existing process |
| 20 | 5 | 1120 | 1080 | 42 | 237 | 530 | 76 | M | 319 | B | 264 | 0.21 | 420 | 1.1 | Example of Invention |
| 21 | | 1120 | 1080 | 0.4 | — | — | — | — | — | | 263 | — | 331 | 1.0 | Comparative Example: existing process |

*M: martensite, B: bainite, P: perlite, F: ferrite

In Table 2, Nos. 1 to 5, 14, 16, 18, and 20 are examples of our steels. These examples exhibited good machinability and fatigue strength 25% higher than that of the products prepared by existing processes.

Nos. 6 and 7 were prepared with a low self-tempering parameter H due to the low temperature at the start of cooling, in which the hardness was significantly increased because of the insufficient tempering of the hardened areas, so that the tool life was poor. No. 8 provided a insufficiently quenched structure because the temperature at the end of cooling was high, so that the fatigue strength was not improved. No. 9 showed insufficient improvement in the fatigue strength because the parameter H exceeded 85. No. 10 was cooled after hot forging at a insufficient cooling rate, so that it provided an insufficiently hardened structure and showed no increase in the fatigue strength. No. 11 is a Comparative Example prepared by an existing common hot forging process. No. 12 was prepared through total quenching after hot forging, which showed improved fatigue strength, but was inferior in the tool life. No. 13 was subjected to local quenching after hot forging, which showed improved fatigue strength, but was inferior in the tool life. Nos. 11, 15, 17, 19, and 21 were prepared by existing processes for comparison of the fatigue strength with locally cooled products.

By appropriately controlling the structure during the hot forging process, the fatigue strength of the hot forged product required to cope with the increased susceptibility to stress caused by the reduction in size and weight is, for example 20% higher than that of a forged product manufactured by known methods. In addition, the areas which are not required to have high fatigue strength, as well as other areas, provide a good machinability when subjected to machining after hot forging, which enables easy finishing.

The invention claimed is:

1. A hot forged product comprising hardened areas introduced by partial cooling after hot forging, and unhardened areas, wherein Vickers hardness $V_1$ of the hardened areas on the surface and Vickers hardness $V_2$ of the unhardened areas satisfy the following formula (1):

$$(V_1-V_2)/V_2:0.1 \text{ to } 0.8 \quad (1).$$

2. The hot forged product according to claim 1, wherein the hardened areas are composed of martensite and/or bainite.

3. A machine structural part made by cold finishing a hot forged product comprising hardened areas introduced by partial cooling after hot forging, and unhardened areas; wherein Vickers hardness $V_1$ of the hardened areas on the surface and Vickers hardness $V_2$ of the unhardened areas satisfy the following formula (1):

$$(V_1-V_2)/V_2:0.1 \text{ to } 0.8 \quad (1).$$

4. The hot forged product according to claim 3, wherein the hardened areas are composed of martensite and/or bainite.

5. A method for making a hot forged product comprising steps of hot forging steel containing 0.3 to 0.9 mass % C, 0.01 to 1.2 mass % Si, and 0.01 to 2.0 mass % Mn, the remainder being Fe and unavoidable impurities followed by partially cooling to harden specific areas of a hot forged product starting from a temperature range of $A_{C3}$+100° C. or higher and ending at a temperature range of $A_{C1}$ −150° C. or lower at a cooling rate of 20° C./s or more, and subsequently tempering the areas by recuperation in the temperature range not exceeding the $A_{C1}$ point such that the parameter H defined by the following formula (2) from the average temperature $T_n$(K) measured over a period of $\Delta T_n$ seconds satisfies $65 \leqq H \leqq 85$ during the period after stopping the cooling to the point where the temperature reaches 300° C. in the temperature reduction process after recuperation: $H=\log_{10}\Sigma 10^{f_n}$ (2) wherein $f_n=\log\Delta T_n-1.597\times 10^4/T_{n+}100$, and $\Delta T_n \leqq 0.5$ seconds.

6. The method for making a hot forged product according to claim 5, wherein the steel further contains one or more selected from 0.05 to 0.60 mass % Mo, 0.01 to 0.06 mass % Al, 0.005 to 0.050 mass % or less Ni, 1.0 mass % or less Cr, 0.1 mass % or less V, 1.0 mass % or less Cu, 0.05 mass % or less Nb, 0.008 mass % or less Ca, and 0.004 mass % or less B.

* * * * *